United States Patent [19]

Strange

[11] Patent Number: 4,671,355

[45] Date of Patent: Jun. 9, 1987

[54] WASH TOOL FOR STIMULATING OIL WELLS

[76] Inventor: Mark D. Strange, 3518 Herndon, Bakersfield, Calif. 93305

[21] Appl. No.: 765,853

[22] Filed: Aug. 14, 1985

[51] Int. Cl.[4] ..... E21B 37/04

[52] U.S. Cl. ..... 166/171; 166/173; 166/174

[58] Field of Search ..... 166/170, 171, 173, 174, 166/312, 55.8; 175/269; 15/104.16, 104.17, 104.19, 104.2

[56] References Cited

U.S. PATENT DOCUMENTS

| | | | |
|---|---|---|---|
| 1,632,015 | 6/1927 | Ventresca | 166/55.8 |
| 1,773,389 | 8/1930 | Church | 166/55.8 |
| 1,806,073 | 5/1931 | MacGregor et al. | 166/171 |
| 1,960,337 | 5/1934 | Gilstrap et al. | 166/55.8 |
| 2,224,412 | 12/1940 | Smith | 166/171 |
| 2,297,020 | 9/1942 | Page | 166/186 |
| 2,574,141 | 11/1951 | Brown | 166/171 |
| 2,857,141 | 10/1958 | Carpenter | 166/174 |
| 2,960,709 | 11/1960 | Peaker et al. | 166/171 |
| 3,648,777 | 3/1972 | Arterbury et al. | 166/312 |
| 4,103,741 | 8/1978 | Daigle | 166/147 |

FOREIGN PATENT DOCUMENTS

| | | | |
|---|---|---|---|
| 717279 | 2/1980 | U.S.S.R. | 166/55.8 |

*Primary Examiner*—James A. Leppink
*Assistant Examiner*—Hoang C. Dang
*Attorney, Agent, or Firm*—Donald D. Mon

[57] ABSTRACT

A wash tool for stimulating oil wells having brushes and/or blades mounted to retractable tool blocks, whereby the brushes or blades can be introduced in the well out of contact with the well liner, and thereafter extended into contact with the liner.

13 Claims, 7 Drawing Figures

WASH TOOL FOR STIMULATING OIL WELLS

FIELD OF THE INVENTION

This invention relates to wash tools for stimulating oil wells by scraping paraffin from the internal wall of the well liner, and by dislodging material from liner perforations which tends to clog them.

BACKGROUND OF THE INVENTION

Especially in oil wells which pump high viscosity, tarry crude, there is a decided tendency for paraffin to adhere to the internal wall of the well liner, and for material such as particulates to clog the perforations in the liner. As a consequence, well production decreases markedly, and it is necessary from time to time to stimulate the well by removing this deleterious material. This process is called "washing" the well. In the course of this process, some of the material may be forced into the formation. This process has the further advantage that it may assist in "breaking" the formation which will open it up to increased flow toward the well.

It is known to use brushes and knives, lowered into the well, to do this work, but in the known prior art, they are fully extended and in contact with the wall of the lines from the time the tool is first lowered into the well. As a consequence, these tool parts, which are subjected to very hard wear, are often nearly worn out before they reach the region intended to be treated, namely the region at and near the perforations. A less efficient treatment is then to be expected. In addition, the tool must be reconditioned more frequently because of the additional wear and the well casing is also subjected to needless wear.

It is an object of this invention to provide a wash tool which carries brushes, or blades, or both as working components in which the working components are not brought into working contact with the well liner until the tool reaches the depth at which the stimulation treatment is to be effected. As a consequence, a new and fresh (or newer and fresher) set of working components works on the selected region, the time between reconditioning is extended, and unnecessary casing wear is averted.

BRIEF DESCRIPTION OF THE INVENTION

A wash tool according to this invention includes a body having a central axis, a downhole end and an uphole end. The lateral dimensions of the body are less than those of the internal wall of the well liner so the tool can be lowered down the well. The body has a central passage, and a plurality of cam guides pass through the wall of the body. Cam followers support respective blocks at the outside of the body, and brushes, or blades, or both, are mounted to the blocks, facing toward the internal wall of the well liner.

A cam shaft is axially shiftable in the central passage, and includes cam surfaces adapted to cam the followers and blocks outwardly or permit them to retract.

Actuator means, preferably a piston-cylinder assembly, functions as actuator means to shift the cam shaft and extend or retract the blocks. Peripheral sliding seals are provided on opposite axial sides of the sets of blocks, to isolate the blocks from the fluids of the well. A by-pass passage through the tool by-passes well fluids past these seals to enable the tool to be lowered into the well and remain there without buoyancy problems.

According to preferred but optional features of the invention, the brushes are stiff wires such as piano wire, and the blades are retractable so as to move into and out of the slit perforations as required to adapt to axial movement of the tool in the well.

The above and other features of this invention will be fully understood from the following detailed description and the accompanying drawings, in which:

BRIEF DESCRIPTION OF THE INVENTION

DETAILED DESCRIPTION OF THE INVENTION

Figure 1:
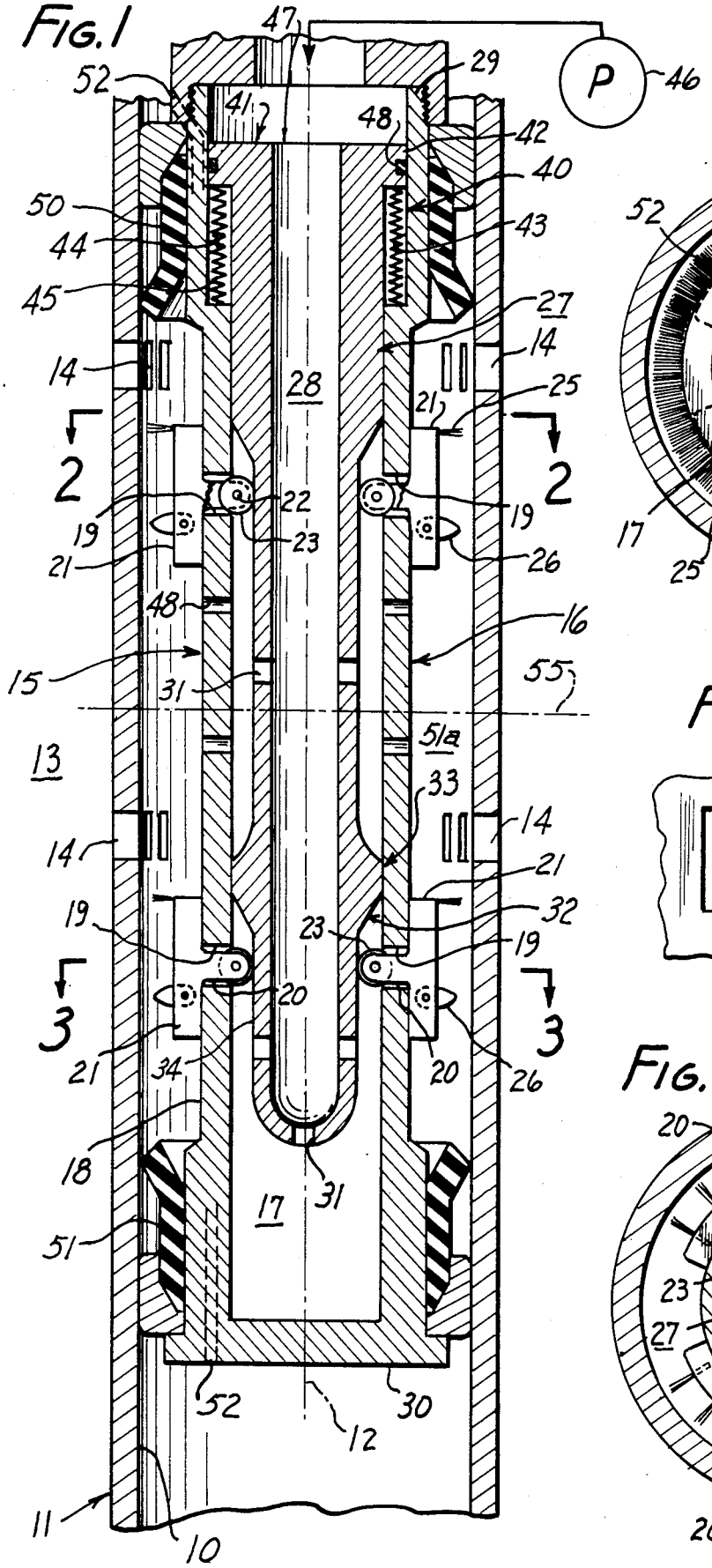
FIG. 1 is an axial section, partly in schematic notation, showing the presently-preferred embodiment of the invention.
Figure 4:
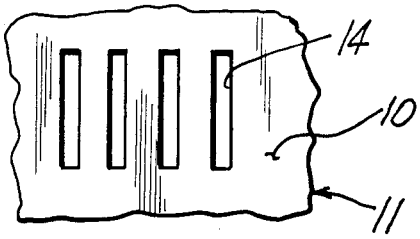
FIG. 4 is a fragmentary view of a portion of the internal wall of the well liner.

The objective of this invention is to stimulate oil well production by "washing" the internal wall 10 of a well liner 11. The well liner has a central axis 12, and is a cylindrical tube. The well liner at the production zone 13 has "patches" of slits 14, as best shown in FIGS. 1 and 4. Although only a few slits are shown, persons knowledgeable in the art are aware that the slotted liners are customarily provided with about 20 rows of slits about 0.040 inches wide and about 2½ inches long, in groups of about 12 slits for each patch. The width, length, and number of rows and patches vary with the diameter of the liner, and with the thickness of the production zone.

The tool 15 according to the invention has as its objective to scrape the internal wall and/or to dislodge material from the slits. The tool has a central body 16 with a central axis coincident with axis 12 when in the well. It has a central passage 17, and an external peripheral wall 18. A plurality of cam guides 19 extend radially from the central passage to the external wall. These serve to guide cam followers 20. In turn, each cam follower mounts and supports a respective tool block 21. The cam followers include a follower shaft 22 and a follower wheel 23.

A brush 25 and a blade 26 (or either alone) are mounted to the block, facing the well liner. These are best shown in the other Figs, and will be described in greater detail later. It is the object of this invention to move these operating tools toward and away from the internal wall of the well liner as desired, so that it will drag along the liner only in those regions to be washed.

A cam shaft 27 is slidably fitted in the central passage of the body. It is elongated and tubular, having a central flow passage 28 opening at the uphole end 29 of the tool. It is capped at its end adjacent to the downhole end 30 of the tool. Flow ports 31 pass through the shaft wall from its flow passage. The fluid circuit through the piston, through passage 28, through ports 48 into the region between seals 50, 51, the body and the inside wall of the well liner is sometimes called a "flushing passage." The same fluid pressure that shifts the piston and cam also causes fluid to flow into this region, and, when the slots are open, into the formation that surrounds the well liner. This flow through the slots tends to loosen the formation.

On the outer periphery of the camshaft, there is a plurality of cams, each comprising a sloping cam surface 32 and a backing surface 33. As is evident from the drawings, when the cam followers bear against some portions of the outer periphery, such as portion 34, the blocks can retract from the liner. When the cam shaft is moved downwardly relative to the outer body, the follower wheels ride up the cam surfaces, and press the blocks outwardly. When the backing surfaces reach them, then the blocks are firmly held extended. The backing surfaces are optional, because the cam surfaces are able to hold the blocks extended, if the cam shaft is held in its shifted position.

Figure 5:
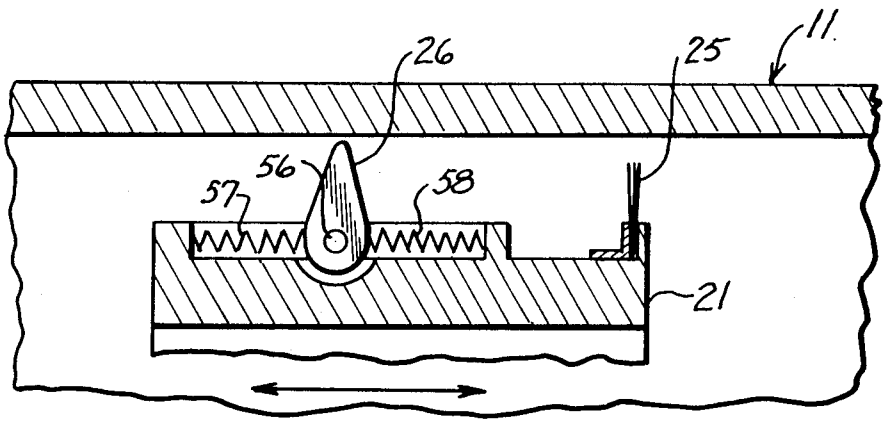
FIGS. 5, 6 and 7 are fragmentary details showing several operating conditions of the tool.
Figure 6:
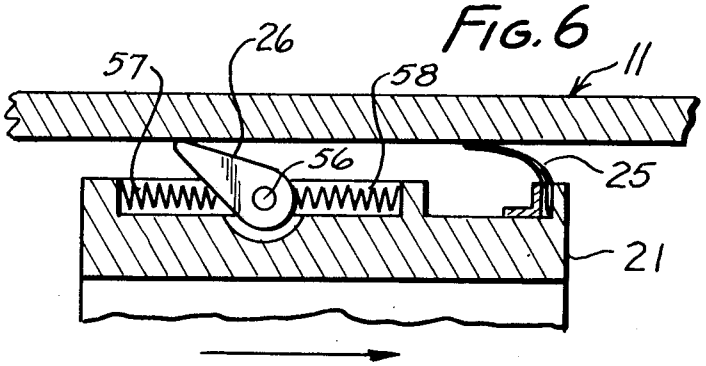
Figure 7:
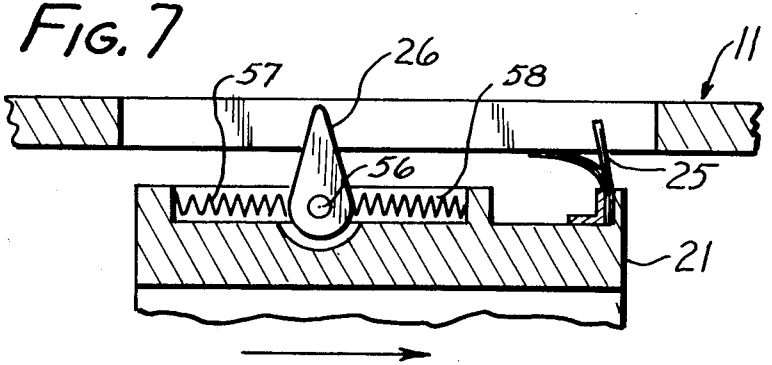

When the blocks are retracted, the brushes and blades are preferably out of contact with the liner wall (FIG. 5). When extended, the brushes make contact with the liner wall, and the blades may or may not be in a slot (FIGS. 6 and 7).

Actuator means 40 acts to shift the cam shaft in the body. Any suitable means to shift the cam shaft may be provided, including motors and magnetic means such as solenoids. However, fluid pressure is a preferred power source, because it is provided as a part of the wash operation anyway. For this reason, the preferred actuator means is a piston/cylinder assembly 41. The piston 42 is formed as an enlarged head on the cam shaft, and the cylinder 43 is formed in the body. The region 44 just below the piston can be vented through the body by a vent port not shown, or otherwise suitably arranged so as not to fluid-lock the piston. A return spring 45 biases the cam shaft upwardly against the fluid pressure. A seal 46 seals between the piston and the cylinder.

A coupling 47 joins the tool to a pipe string (not shown) by means of which the tool is lowered into the well, and withdrawn from it. A pump 46 supplies wash fluid under pressure to flow passage 28.

Flow ports 48 through the wall of the body complete a flow path from passage 28 to the region to be washed. The slots in the liner continue the flow pattern to the formation. Therefore there will be a differential pressure across the piston which will hold the cam shaft in the actuated position when sufficient pressure is applied. The return spring is optional, and may be omitted if one-shot operation of the tool is preferred. In that situation, the brushes would drag all the way out of the well, and the tool would be "reset" at the surface.

Cup seals 50, 51 surround the body, and extend radially to make contact with the wall of the liner. They serve to isolate a region 51*a* in which washing is to occur, from the well bore above and below the tool. Because this arrangement prevents flow past the outer wall of the tool, it would tend to make the tool buoyant, or frustrate lowering it into the wall. For this reason, a by-pass passage 52 extends through the body from below seal 51 to above seal 50. It is shown only schematically to simplify the drawings. In actual practice, it is best formed as a key slot in the outer wall of the body, which is covered by a plate welded to it. It is, of course, angularly spaced from the cam guides.

Figure 2:
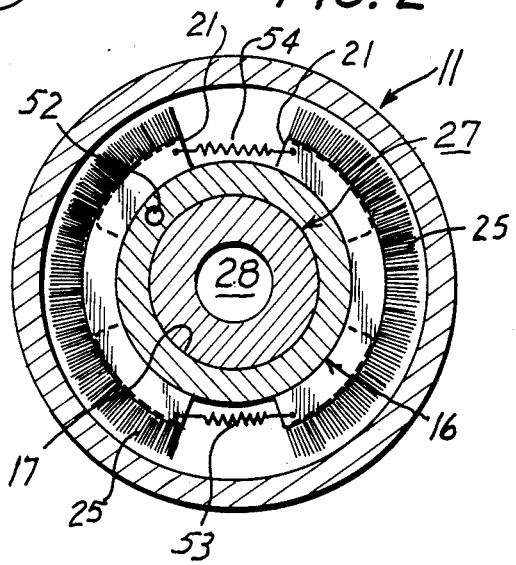
FIG. 2 is a cross-section taken at line 2—2 in FIG. 1.
Figure 3:
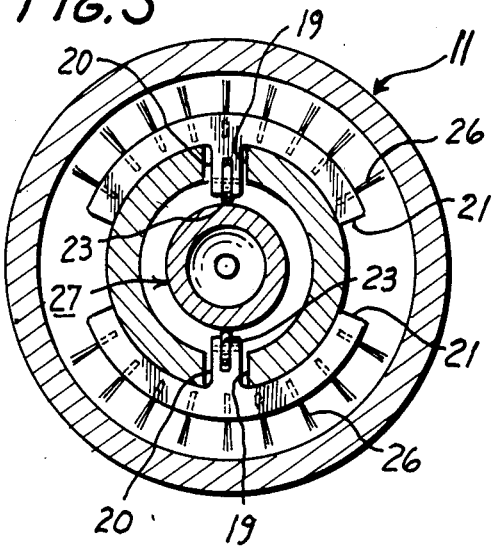
FIG. 3 is a cross-section taken at line 3—3 in FIG. 1.

As best shown in FIGS. 2 and 3, the blocks are formed as arcs, about 140 degrees each. They are in sets of two, diametrically across from each other, and biased inwardly by tension springs 53, 54. These springs also act as return springs.

Section line 55 is intended to show that in the drawings the tool below it has been rotated 90 degrees relative to the tool above it. This is reflected in the angular relationship between the upper blocks shown in FIG. 2, and the lower blocks shown in FIG. 3. Between the sets, the entire periphery of the liner is at least covered, and perhaps more.

The brushes may be an array of parallel lengths of stiff piano wire. They are stiff enough and hard enough to scour the wall of the liner, bending somewhat while they do so.

The blades must be retractible, for they must enter and leave the slots. They are somewhat thinner than the width of the slots so they can enter them. They are pivotally mounted by pivot pins 55 in slots 56, and are centered by centering springs 57, 58. In practice, the tool turns in the well as it pulls up, and soon one of the blades will line up with a slot. When it does, so will the others, and as many aligned blades as exist will enter respective slots. Redundancy can be provided by putting several arrays of similarly aligned blocks on the tool. Then the likelihood that every slot will be treated by a blade will increase.

The operation of the tool should be evident from the foregoing. The tool is attached to the pipe string, with the cam shaft in its upper position. It may be lightly retained there, if desired to hold it until actuating force is applied. A snap ring (not shown) would be suitable for this purpose. By pass flow through the by-pass passage enables or facilitates the lowering of the tool. The blocks are retracted at this time (FIG. 5).

When the production zone is reached, pressure is applied by the pump, and the cam shaft moves down to force the blocks outwardly. The tool is then pulled up. The brushes scrape along the wall, and the blades, when they are not in a slot, retract (FIG. 6). When they are in a slot, they are centered (FIG. 7).

The wash flow is through the ports and slots into the formation, and this flow disposes of some of dislodged material. The rest of it is raised with the tool.

The blocks may be retracted by stopping the pressure flow if desired, to reduce wear on the tool and liner, above the production zone.

Means other than pivotal can be used to enable the blades to retract.

This invention provides a rugged, simple and effective tool for stimulating oil wells.

This invention is not to be limited by the embodiments shown in the drawings and described in the description which are given by way of example and not of limitation, but only in accordance with the scope of the appended claims.

I claim:

1. A wash tool for stimulating an oil well by washing the internal wall of a well liner, said well liner having an axis and slots therein, and said internal wall being subject to being coated with paraffin, said tool being adapted to scrape paraffin from said internal wall, said tool comprising:

a body having a central axis, a downhole end, an uphole end, an axially extending peripheral boundary having radial dimensions smaller than those of said internal wall, a central passage, a plurality of radially extending cam guides passing through said body from the central passage to the boundary, a plurality of tool blocks, each block having an extended position closer to said internal wall and a retracted position more distant from said internal wall, and bearing a stiff brush adapted to scrape the wall of the lining, a cam follower fixed to each of said blocks, passing through a respective cam guide and projecting into said central passage;

an axially extending cam shaft supported in said central passage for axial movement therein, said cam shaft bearing a plurality of cam surfaces, said cam surfaces sloping so as to engage a respective cam follower and thrust it away from said axis whereby to press said block and brush toward said extended position when axially moved toward said cam follower;

a pair of axially spaced apart seals, one up-hole and one down-hole from said blocks to isolate said blocks from the well liner above and below them; said body including a by-pass passage opening into the well liner above and below said pair by passing the region between the tool, the internal wall and the two seals; actuator means to shift the cam shaft axially relative to said body, said actuator means comprising a cylinder formed in said body, a piston linked to said cam shaft and slidably fitted in said cylinder and exposed to fluid pressures uphole from said wash tool to move said piston and thereby said cam shaft, there being a flushing passage through said tool extending from the uphole end of said tool into the said region defined by the exterior surface of the tool body, the internal wall, and the two seals, whereby fluid pressure which shifts the piston and the cam shaft also forces fluid through said flushing passage, into said region, through said slots, and into the formation outside of the liner.

2. A wash tool according to claim 1 in which said cam shaft further includes a backing surface adjacent to each said cam surface, whereby to support the cam follower and block in said extended position.

3. A wash tool according to claim 1 in which a return spring biases the cam shaft toward a position where the block is retracted toward said retracted position.

4. A wash tool according to claim 1 in which said brush comprises a plurality of radially-extending stiff wires.

5. A wash tool according to claim 1 in which a plurality of said blocks is assembled around the body, and are spring-retained toward said retracted position.

6. A wash tool for stimulating an oil well by clearing and washing slots in a well liner, said well liner having an axis and an internal wall, and said slots being subject to being clogged, said tool being adapted to enter said slots to clean them, said tool comprising:

a body having a central axis, a downhole end, an uphole end, an axially extending peripheral boundary having radial dimensions smaller than those of said internal wall, a central passage, a plurality of radially extending cam guides passing through said body from the central passage to the boundary;

a plurality of tool blocks, each block having an extended position closer to said internal wall and a retracted position more distant from said internal wall, and bearing a plurality of retractible blades extending parallel to said axis and adapted to enter said slots to clean them, and retract to pass along the liner wall, and a cam follower fixed to each of said blocks passing through a respective cam guide and projecting into said central passage;

an axially extending cam shaft supported in said central passage for axial movement therein, said cam shaft bearing a plurality of cam surfaces, said cam surfaces sloping so as to engage a respective cam follower and thrust it away from said axis whereby to press said block and blades toward said extended position when axially moved toward said cam follower;

a pair of axially spaced apart seals, one up-hole and one down-hole from said blocks to isolate said blocks from the well liner above and below them, said body including a by-pass passage opening into the wells above and below said pair;

actuator means to shift the cam shaft axially relative to said body, said actuator means comprising a cylinder formed in said body, a piston linked to said cam shaft and slidably fitted in said cylinder and exposed to fluid pressures uphole from said wash tool to move said piston and thereby said cam shaft, there being a flushing passage through said tool extending from the uphole end of said tool into the said region defined by the exterior surface of the tool body, the internal wall, and the two seals; whereby fluid pressure which shifts the piston and the cam also forces fluid through said flushing passage; into said region; through said slots; and into the formation outside of the liner.

7. A wash tool according to claim 6 in which said cam shaft further includes a backing surface adjacent to each said cam surface, whereby to support the cam follower and block in extended position.

8. A wash tool according to claim 6 in which a return spring biases the cam shaft toward a position where the block is retracted toward said retracted position.

9. A wash tool according to claim 6 in which said blades are pivotally mounted to said blocks, and are spring biased to a central, extended, position.

10. A wash tool according to claim 1 in which said well liner is slotted with axially extending slots liable to be clogged, and in which said blocks are further provided with retractible blades to enter said slots and clean them, and to retract to pass along the liner wall.

11. A wash tool according to claim 10 in which said blades are pivotally mounted to said blocks, and are spring biased to a central, extended, position.

12. A wash tool according to claim 1 in which said flushing passage extends through said piston, said cam shaft, and through said body to said region.

13. A wash tool according to claim 6 in which said flushing passage extends through said piston, said cam shaft, and through said body to said region.

* * * * *